United States Patent [19]

Tobias

[11] Patent Number: 4,688,482

[45] Date of Patent: Aug. 25, 1987

[54] INK TRANSFER ARRANGEMENT

[76] Inventor: Philip E. Tobias, 1872 Watson Rd., Abington, Pa. 19001

[21] Appl. No.: 824,614

[22] Filed: Jan. 31, 1986

[51] Int. Cl.[4] ..... B41F 31/06; B41F 31/04

[52] U.S. Cl. ..... 101/350

[58] Field of Search ..... 101/DIG. 6, 350, 349, 101/351, 352, 148

[56] References Cited

U.S. PATENT DOCUMENTS

| | | | |
|---|---|---|---|
| 3,037,450 | 6/1962 | Davis | 101/350 |
| 4,524,692 | 6/1985 | Rodvelt | 101/350 |
| 4,577,556 | 3/1986 | Fischer | 101/DIG. 6 |

FOREIGN PATENT DOCUMENTS

| | | | |
|---|---|---|---|
| 2516863 | 11/1981 | France | 101/DIG. 6 |

*Primary Examiner*—J. Reed Fisher

*Attorney, Agent, or Firm*—William E. Cleaver

[57] ABSTRACT

The present device comprises a plurality of doctor blades, each of which, in a preferred embodiment, has a width of a key zone. Each of the blades is disposed to be moved between the fountain roller of a printing press and the receiver roller of a roller train in the printing press. Each doctor blade is held by some force such as a solenoid in a first position whereat it scrapes away ink from the fountain roller for a predetermined time, so that the amount of ink lifted from the fountain roller is predictable which at the same time the system provides for changing the predetermined time to enable the amount of ink removed from the fountain roller to be varied. Each of the doctor blades is returned to a second position when the force is terminated, whereat each of the doctor blades comes in contact with a receiver roller which acts to wipe the ink from the respective doctor blades thus completing the transfer of ink from the fountain roller to the receiver roller of the roller train of a printing press. The amount of time that each blade is located in the first position is selectively controlled by a microprocessor in the preferred embodiment.

6 Claims, 5 Drawing Figures

INK TRANSFER ARRANGEMENT

BACKGROUND OF THE INVENTION

In the prior art, ink has been transferred from the fountain to the image plate by transferring ink from one roller to another along a roller train. Initially the ink is passed from the fountain to a fountain roller and the thickness of the ink applied to the fountain roller is determined by the gap between a single fountain blade, or a segmented fountain blade, and the fountain roller. As is well understood in the prior art, there is a plurality of keys, or screws, located on the underside of the fountain blade. The keys come in contact with the fountain blade at different height settings thereby providing different gap thicknesses between the fountain blade and the fountain roller, along the length of the fountain blade. The different gap thicknesses, of course, provide for different amounts of ink to be applied to the fountain roller, along the length of the fountain roller. The different amounts of ink being applied to the fountain roller accommodate the different dimensions of the areas to be inked on the image plate. In the prior art, a ductor roller is employed to initially lift ink from the relatively slow speed fountain roller. Thereafter, the ductor roller is physically moved to transfer the ink, that it has received from the fountain roller, onto a high speed receiver roller, in batches. As the ink is transferred from the receiver roller and thereafter from one roller to another in the roller train, the batches are smoothed out until finally ink is transferred to a form roller which functions to apply the ink to the image plate.

The above described method of transferring ink from the reservoir to the image plate has several disadvantages. Continuous blades, as opposed to segmented blades, are difficult to adjust because the more flexible the blade the more localized is the effect of the key and the more likely that the hydrodynamic pressure of the ink in the gap will push the blade away from the fountain roller in the areas between the keys. While rigid blades reduce the bowing of the fountain blade between keys, such rigid blades make it difficult to obtain an ink fed profile that enables widely diverse ink feeds to correspond to the needs of the plate image distribution. Segmented blades have been developed to counter the problems related to continuous blades as set forth above. However segmented blades have their own problems which result because ink and solvents get between the segments and cause mechanical malfunctions. In some prior art systems, which use segmented blades, a plastic shield has been located between the segmented mechanism and the fountain roller but such a shield has incurred wear problems causing the gap to change with time and use.

All of the foregoing prior art systems suffer from a serious problem related to effecting a precision setting of the ink gap particularly when the system requires low settings. For instance, assume that the image plate is comprised of a large area on one side of the plate to be inked, while the other side has a small postage stamp sized area to be inked. The dwell, or the sweep, of the ductor roller on the ink fountain roller must be adequate to allow a practical opening (perhaps an opening of 0.015 inches) of the keys which lie opposite the large area to be inked. On the light coverage side the ink gap would likely be held down to perhaps 0.001 inches or less. It may be that the run-out of the fountain roller may be 0.001 inches and there would be bowing of the roller and fountain blade from the hydrodynamic pressure of the ink. The hydrodynamic pressure, in turn, will vary with the speed of the press. It can be readily seen from the foregoing conditions that problems do result if the user does attempt to preset the fountain blade gap to accommodate different demands for ink on the image plate. Another set of problems results, in the prior art systems, from the inability to set a zone to a zero feed. When no feed is required, i.e., at the non-printing areas of the plate, the key closure can wear and bow the fountain roller thereby affecting other key settings.

Still another problem, that is inherent in the prior art arrangement, is the problem of the varying momentum of the ductor roller. The ductor roller in the prior art alternately runs in contact with the high surface speed of the receiver roller and then runs in contact with the relatively slow speed of the fountain roller. When the ductor roller leaves the receiver roller it is spinning at a very high speed and as it comes in contact with the fountain roller it skids due to the deceleration it experiences in adapting to the slow speed of the fountain roller. Such skidding results in an initial non-predictable transfer of ink. The transfer of ink is different during the early contact between the fountain roller and the ductor roller from that which takes place when the two rollers, i.e., the fountain roller and the ductor roller, are rolling together at the same speed. In the present system, the fountain gap is maintained at a relatively fixed width and thereby many of the above mentioned problems are eliminated.

SUMMARY OF THE INVENTION

The present device is used in a printing press and employs a plurality of doctor blades, each of which is mounted on a support and is designed to be partially rotatable around such support. Each of the doctor blades is connected to a source of motion, such as a solenoid, so that it can be partially rotated, clockwise and counterclockwise, into one of two positions. The first of the positions is in close proximity to the fountain roller of the printing press, while the second position is in close proximity to the receiver roller. When a doctor blade is close to the fountain roller, it scrapes ink from the fountain roller and the amount of ink that is scrapes depends on how long a doctor blade is held against the fountain roller. Since each doctor blade is individually movable into the first position, the amount of ink lifted, or scraped, can vary from doctor blade to doctor blade. When the associated solenoids are deenergized, each doctor blade returns (the blades are spring loaded in a preferred embodiment) to the second position which is a wiping position. In the wiping position, ink is wiped from the doctor blades by a receiver roller and is carried therefrom, through a roller train, to the image plate for inking the image plate. The initial transfer of the ink from the reservoir to the fountain roller provides the basis for the quantity of ink applied to the image plate, in the prior art. In the present system the gap between the fountain roller and the fountain blade is held constant and the ink transfer, that provides the basis for the quantity of ink that is applied to the image plate, is effected by the amount of time the doctor blades are held in the first position, i.e. the scraping position.

The objects and features of the present invention will be better understood in view of the following description taken in conjunction with the drawings wherein.

Figure 1:
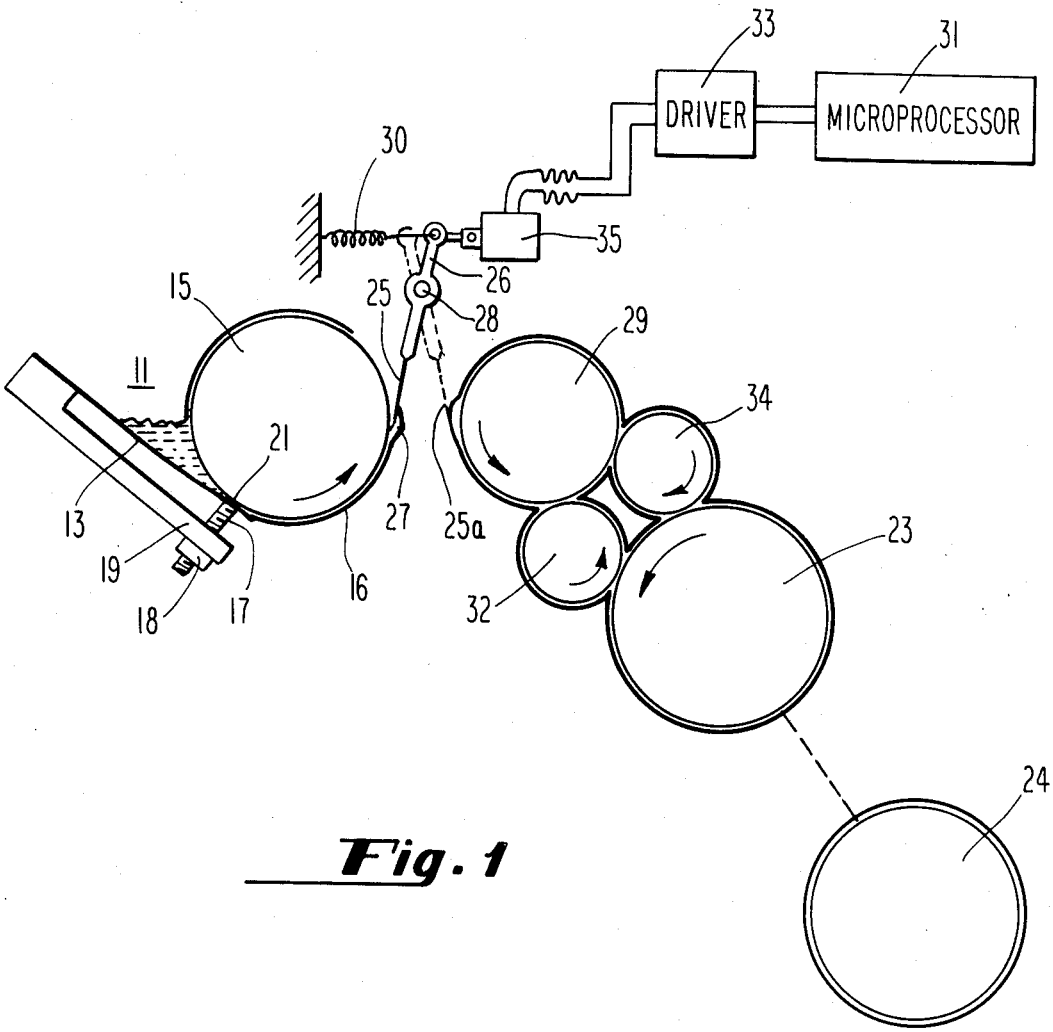
FIG. 1 is a schematic layout of the present device operating in conjunction with the fountain roller and roller train of a printing press.

Consider FIG. 1. In FIG. 1 there is shown an ink reservoir 11 and a fountain blade 13 located with the reservoir. The fountain blade is located in close proximity to the fountain roller 15 so that there is a gap 21 between the fountain blade 13 and the surface of the fountain roller 15. The gap 21 permits ink to be metered from the reservoir 11 onto the surface of the fountain roller 15. The metered ink 16 can be seen clinging to the fountain roller 15.

Further as can be gleaned from FIG. 1 the fountain blade 13 is held either closer or farther away, from the fountain roller, depending upon the position of the key 17. The key 17 is a threaded member which is threaded into the key holder 19. As can be determined from an examination of Figure 1, when the key 17 is rotated upward the fountain blade 13 comes closer to the fountain roller 15 and hence less ink is metered out to the fountain roller. On the other hand when the key 17 is moved downward then the gap becomes larger and a larger amount of ink is offered to the fountain roller 15. The key 17 is locked into position by the nut 18. It should be understood that in a preferred embodiment the fountain blade is a fixed blade and need not be varied by keys. In a preferred embodiment the gap 21 is held constant at approximately 0.01 inches although other gap widths could be used. There is no need, in the present system, to vary keys because, as will be understood from this description, while the determination of the amount of ink transferred is to some degree dependent upon the width of the gap, it is controlled principally by the time that the doctor blades are in the scraping positions.

As the ink 16, clinging to the fountain roller 15, is moved upward it comes in contact, (as shown in FIG. 1), with the doctor blade 25. As can be seen in FIG. 1, there is a build up of ink 27 on the doctor blade 25 as the ink 16 is scraped away from the fountain roller 15. The position of the doctor blade 25 (in solid lines) is the first position, or the scraping position, while the doctor blade and the doctor blade holder are depicted by the dashed line in the second position, or the wipe off position of the doctor blade. When the system is directed to remove ink from the fountain roller 15 and transfer it to the receiver roller 29 (so that ultimately it is transferred to the distribution roller 23) there is a signal generated at the microprocessor 31. It should be noted, as depicted by the dashed line in FIG. 1, that there is a number of rollers between the distribution roller 23 and the form roller 24. The signal from the microprocessor 31 is transmitted to the driver 33 whereat its electrical current value is amplified and hence the actuator or solenoid 35 is activated. When the solenoid 35 is energized, it pulls the doctor blade holder 26 in a clockwise direction. The doctor blade holder 26 rotates on the bearing 28 and moves the doctor blade 25 in close proximity and, in a preferred embodiment, in contact with the fountain roller 15. As explained above, when the doctor blade 25 is in the position shown in FIG. 1, it is lifting ink, or scraping ink, away from the fountain roller 15.

It should be understood that the amount of ink 27, which is lifted onto the doctor blade, is directly proportional to the amount of time that the doctor blade 25 is in the first position (i.e., the position shown in FIG. 1). The microprocessor 31 of course makes that time determination through a program and provides a continuing signal for that time which signal is amplified to energize the solenoid 35. When the program in the microprocessor has caused the solenoid to be energized for a sufficiently long time, (so that enough ink has been lifted), then the signal therefrom, through the driver 33 to energize the solenoid 35, is terminated. When the solenoid 35 is deenergized, the doctor blade holder is pulled to the left by the spring 30 and hence the doctor blade 25 is moved to the right and is located in the position shown by the dashed doctor blade **25*a*. When the receiver roller 29, which is moving counterclockwise, is rotated, it wipes the ink build up 27 from the doctor blade 25*a*. As explained above, the ink is loaded onto the receiver roller 29 in mounds. The receiver roller 29 transports the ink and comes in contact with the intermediate roller 32 and 34 which in turn transfer the ink to the distribution roller 23. The ink is transferred from the distribution roller 23 to a train of rollers, signified by the dashed line, which train ends in a form roller 24**. The microprocessor of a preferred embodiment is a model 280 manufactured by Zilog Company and the driver can be any well known circuit which converts a logic level signal to a higher voltage and current to meet the design requirements of the solenoid used. Other microprocessors could be used and the driver design depends on the solenoid employed.

It should be recognized that if the doctor blade 25 returns repeatedly to lift ink from the fountain roller then the amount of ink applied to the receiver roller would be substantial. Accordingly not only is the time that the doctor blade is in contact with the ink on the fountain roller one of parameters (that is employed by the microprocessor), but the repetition rate of transferral of the doctor blade 25 between its **25*a* position and its 25 position is also a highly desirable factor that the microprocessor employs. It can be noted in FIG. 1 that the doctor blade 25 and the doctor blade holder 26 are depicted as being operated by the solenoid 35 and the spring 30 by way of illustration. In the preferred embodiment the doctor blade is arranged with its holder as shown in FIG. 2**.

Figure 2:
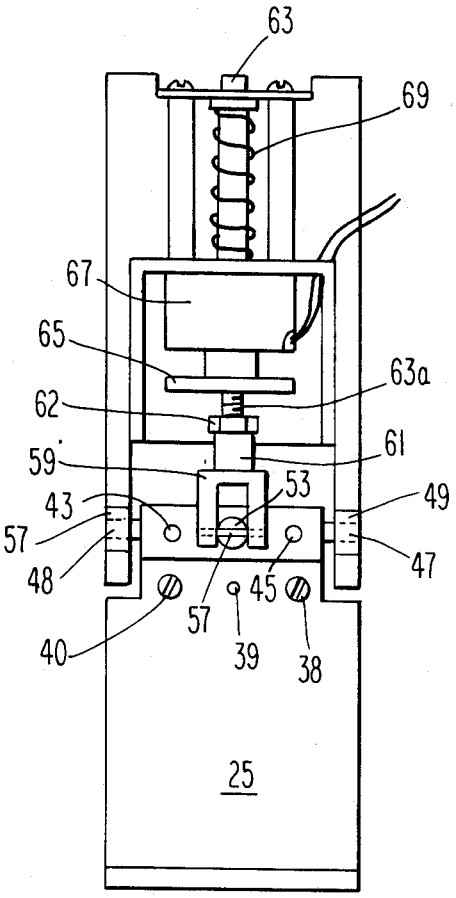
FIG. 2 is the front view of a doctor blade mounted on a support device and coupled to an actuator.

In FIG. 2 the doctor blade 25 is shown with the surface that comes in contact with the fountain roller facing out from the drawing. Behind the doctor blade is a stiffening means 37 which can be seen in both FIG. 2 and FIG. 3. The stiffening means 37 is secured to the doctor blade by two bolts 38 and 40 and located by pin 39. I have found that if the stiffening means 37 is not employed as shown, the doctor blade 25 (which is necessarily quite flexible) will often cling to the ink 16 as the spring returns the doctor blade 25 to the receiver roller 29. This delayed motion results in an unsatisfactory transfer of ink and the delay is eliminated by using the stiffening means 37.

Figure 3:
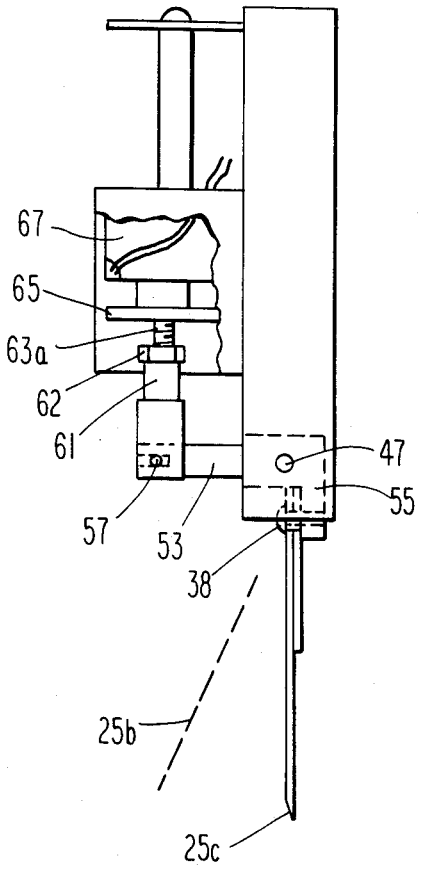
FIG. 3 is a side view of FIG. 2.

The bolts 38 and 40 are threaded into an inverted "L" shaped holder 55 as can be seen from the position of bolt 38 in FIG. 3. The upper section of the holder 55 has two apertures 43 and 45 formed therein. Each of the apertures 43 and 45 is threaded to hold an internal nut, such as an Allen nut. The nut in threaded aperture 43 secures the holder 55 to the rod 48 while the nut in aperture 45 secures the holder 55 to the rod 47. The rod 47 is held in the bearing 49 while the rod 48 is held in the bearing 51. The lever 53, which can be better seen in FIG. 3, is secured to the holder 55 and is designed to fit over the pin 57. The pin 57 is held by the block 59. Secured to the block 59 is an internally threaded member 61 into which the rod 63 is threaded. As can be seen in FIGS. 2 and 3, the rod 63 has a lower section 63*a* which is threaded and it is that portion of the rod which is threaded into the threaded member 61. The threaded section 63*a* is locked to the member 61 by the nut 62.

As can be further seen in FIGS. 2 and 3, there is secured to the rod 63 a washer-like member, or flange, 65. The flange 65 serves as a travel stop for the rod 63. The rod 63 passes through the core of the solenoid 67. When the solenoid 67 is energized the rod 63 moves upward until the flange 65 comes in contact with the housing of the solenoid 67. The movement upward by the rod 63 pulls the block 59 upward which in turn partially rotates the lever 53. When lever 53 moves clockwise the block 55 moves clockwise, thereby moving the doctor blade 25 clockwise to the position shown at 25*b* in FIG. 3. As long as the solenoid 67 is energized, the doctor blade 25 will be held in the 25*b* position and will be lifting ink from the fountain roller as explained above. The spring 69 is seated in a ring which surrounds and is fixed to the rod 63. When the solenoid 67 is deenergized, the spring 69, will partially uncoil to push the rod 63 downward to its home position. When the rod 63 moves downward it pushes the block 59 downward. The downward movement of the block 59 causes the lever 53 to move counterclockwise thus causing the doctor blade 25 to move counterclockwise. The doctor blade 25 will return to the 25*c* position which is the wipe-off position described earlier. When the doctor blade is in the 25*c* position the receiver roller wipes the ink from the doctor blade 25 and that ink is transported through the roller train to the form roller 24 of FIG. 1.

Figure 4:
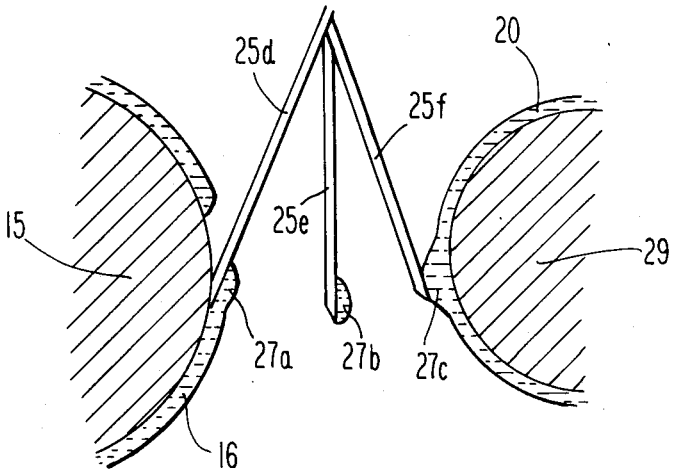
FIG. 4 depicts three positions of the doctor blade transferring ink.

FIG. 4 depicts the actual transfer of the ink from the fountain roller 15 to the receiver roller 29. Throughout the description I have referred to a fountain roller and a fountain as the source of the layer of ink but it should be understood that some other apparatus could well provide a layer of ink and be within the spirit of the present invention. In FIG. 4 the doctor blade 25 is in three positions 25*d*, 25*e* and 25*f*. When the doctor blade 25 is in position 25*d*, it is scraping the layer of ink 16 from the fountain roller 15. Note the mound of ink 27*d* which is being lifted from the layer of ink 16. The mound of ink 27*d* is shown in the transfer state, as 27*b*, riding on the doctor blade in the 25*e* position. FIG. 4 further shows the doctor blade in the 25*f* position with the mound of ink 27*c* joining the layer 20. Because there is a difference in the speed of the roller 29 (which is at some positive value) and the at rest value of the ink at the surface of the doctor blade, the ink will form the mound 27*c*, even though the doctor blade is attempting to push the mound of ink into the layer. The mound of ink 27 eventually gets smoothed out in the roller train.

Figure 5:
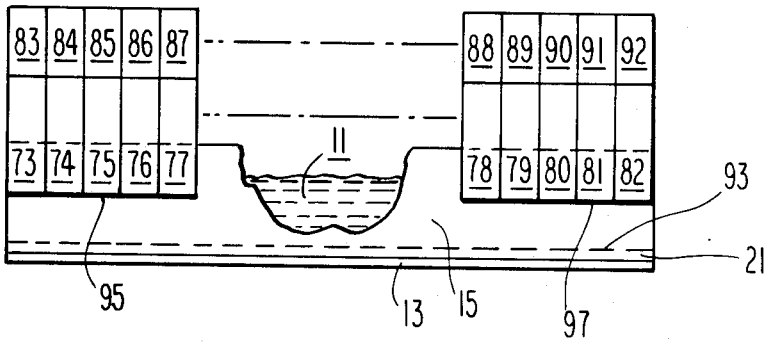
FIG. 5 depicts an array of doctor blades as they are aligned with the fountain roller and without the distribution roller.

FIG. 5 depicts a plurality of doctor blades 73, 74, 75, 76, 77, 78, 79, 80, 81 and 82. In FIG. 5 the distribution roller is not shown but it should be understood that the blades with the lesser amounts of ink thereon have left the fountain roller and are in the position where they would normally be wiped by the distribution roller. The dashed lines between doctor blades 77 and 78 is to indicate that there are many doctor blades therebetween. In a preferred embodiment each doctor blade would be about 1½ inches wide and there would be as many doctor blades employed as would be necessary to accommodate the width of the press. Each of the doctor blades 73 through 82 is connected to an activating mechanism shown by the blocks 83 through 92. It is to be understood that the activating mechanisms 83 through 92 are of the kind depicted in FIGS. 2 and 3 and described above. It should also be understood that the movement of the doctor blades, in a preferred embodiment, is synchronized with the speed of the printing press although other speeds could be provided by the microprocessor if it were deemed advisable.

As can be further seen in FIG. 5, the doctor blades 73 through 82 are lined up with the fountain roller 15. Between the fountain blade 13 and the fountain roller 15 there is a gap 94 whose upper limit is shown by the dashed line 93. The dashed line 93 is the lower edge of the fountain roller 15. The ink is shown, in FIG. 5, as leaving the reservoir through the gap 94 and clinging to the fountain roller 15. The ink (e.g., mounds of ink 95 and 97) is further shown as being scraped off on the doctor blades. It should be understood that (in a preferred embodiment) all of the doctor blades are transferred to the fountain roller at the same time but they are, or can be, transferred therefrom at different times. In FIG. 5, for instance, there is shown a mound of ink 95 on the doctor blade 75. Note that the mound of ink 95 is greater than the mound of ink 97 on doctor blade 81. In accordance with operations described earlier it is evident that the doctor blade 75 has been held in its scraping position for a longer period of time than the doctor blade 81. The present device, as can be further seen in FIG. 5, enables the doctor blades to lift and meter out different amounts of ink to the roller train to accommodate different demands for ink at the image plate. It should be understood that these different amount of inks are very accurately metered out because there are not variations in key settings involved. The gap 94 is held constant and the variation of the ink metered out is effected by varying the times that the doctor blades are held in the scraping position.

One of the major advantages of the present system is the capability of the present system to skip ink transfers. In the prior art, the ductor roller is fixed (to transfer on each given occasion) by a gear train arrangement. The fixed transfer leads to particular difficulty when portions of the image plate require very little ink. When very little ink is required, in the prior art, the gap between the fountain roller and the fountain blade is adjusted by the keys to be relatively small. However, the gap must be large enough to provide ink to the fountain roller. As mentioned earlier, these small settings give rise to problems and make a basis for a difficult compromise. Be that as it may, when a prior art system is operating, the ductor roller transfers ink at a regular pace and if less ink than is necessary is being supplied there is no simple way, in the prior art, to remedy the situation. With the present system, if very little ink is required, the ductor blade can be transferred for a relatively long period (or alternatively for a short period) and thereafter one, or two, or any number of ink transfers can be skipped until there is a need for more ink to be transferred.

The many problems that are present in ink transfer systems in the prior art which result from: setting key height to different values; having segmented fountain blades; having rigid blades; hydrodynamic pressuer of the ink in the gap; bowing of the fountain roller, etc., as set out earlier under the "background" section of this description are eliminated by using the present system.

I claim:

1. In a printing press arrangement which has (1) a means to provide a layer of ink which ink is received from an ink source and (2) receiver roller means which delivers ink through a roller train to an image plate, a system to transfer ink from said means to provide a layer of ink to said receiver roller means, comprising in combination:

a plurality of doctor blade means each formed to be selectively and individually movable in both first and second directions, each of said doctor blade means disposed with respect to both said means to provide a layer of ink and said receiver roller means so that when each of said doctor blade means is moved in said first direction, it comes in sufficiently close proximity to said means to provide a layer of ink to scrape ink therefrom and so that when said doctor blade means is moved in said second direction, it comes in sufficiently close proximity to said receiver roller means to have at least part of the ink, which was scraped by said doctor blade means, removed therefrom by said receiver roller means; a plurality of individual moving means with each respectively connected to an associated different one of said doctor blade means whereby each of said doctor blade means can be selectively and individually moved in both said first direction and said second direction, each of said moving means formed to selectively move each associated said doctor blade in said first direction for different time periods whereby when each said moving means has selectively moved each associated said doctor blade means in said first direction for different time periods, and subsequently in said second direction, different amounts of ink are transferred from said means to provide a layer of ink to said receiver roller means which different amounts of ink are commensurate with said different time periods.

2. A system to transfer ink according to claim 1 wherein each of said moving means includes a solenoid having a movable core member and linkage means coupled between said movable core member and said doctor blade means whereby when said solenoid is energized said movable core member moves and in turn moves said linkage means which in turn moves said doctor blade means.

3. A system to transfer ink according to claim 1 wherein there is further included a microprocessor connected to said plurality of moving means to provide selected electrical signals thereto.

4. A system to transfer ink according to claim 1 wherein each of said doctor blades is formed to be the width of a zone on said image plate.

5. In a printing press arrangement wherein the image plate is divided into printing zones, a system to transfer ink from the exit means of a reservoir of ink to an image plate, comprising in combination: fountain roller means, having a length dimension and located at said exit means of said reservoir of ink; fountain plate means formed to be substantially as long as said fountain roller means and located below said fountain roller means to form a substantially fixed gap therebetween to permit ink to leave said reservoir at an established thickness with said ink clinging to said fountain roller means; a plurality of doctor blade means aligned along the length of said fountain roller means; a plurality of moving means with each respectively connected to an associated different one of said doctor blade means whereby each of said doctor blade means can be independently moved into a first position for a different period of time, which first position is in close proximity to said fountain roller means whereby ink, which is clinging to said fountain roller means, is scraped therefrom by each doctor blade in a volume which is commensurate with the time period that said doctor blade is held in said first position and whereby each of said doctor blade means is independently moved by its associated moving means into a second position and whereby different amounts of ink can be transferred uniformly in a given time period within a printing zone; receiver roller means having a length dimension which is substantially equal to the length of said fountain roller means, said receiver roller means located in close proximity to said plurality of doctor blade means whereby when each of said doctor blade means is in said second position, ink which was scraped from said fountain roller means by said doctor blade means is substantially wiped from said doctor blade means by said receiver roller means; and roller train means disposed to rotationally move in close proximity to said receiving roller means and to said image plate to receive ink from said receiving roller means to be transferred to an image plate.

6. A system to transfer ink according to claim 1 wherein each of said doctor blades is disposed on a single different axis so that each of said doctor blades moves exclusively in a rotating direction.

* * * * *